United States Patent [19]
Becker
[11] 4,221,024
[45] Sep. 9, 1980

[54] APPARATUS FOR SUSPENDING ARTICLES, SUCH AS SKIS, FOR CONVENIENT STORAGE

[76] Inventor: Harvey W. Becker, 16 Huxley Way, Fairport, N.Y. 14450

[21] Appl. No.: 2,429

[22] Filed: Jan. 10, 1979

[51] Int. Cl.³ ..... F16G 11/14
[52] U.S. Cl. ..... 24/115 H; 289/1.2
[58] Field of Search ..... 24/115 H, 115 K, 73 SG, 24/81 SK, 49 S; 289/1.2

[56] References Cited

U.S. PATENT DOCUMENTS 2,713,706 7/1955 Bidgi ..... 24/115 X

FOREIGN PATENT DOCUMENTS 1903016 8/1970 Fed. Rep. of Germany ..... 24/115 H

*Primary Examiner*—Kenneth Downey
*Attorney, Agent, or Firm*—Martin LuKacher

[57] ABSTRACT

Skis or other articles having curved ends are suspended by means of an inter-looped strand which forms adjustable loops through which the curved ends extend. A slide is used to adjust the loops and lock the article in place.

11 Claims, 2 Drawing Figures

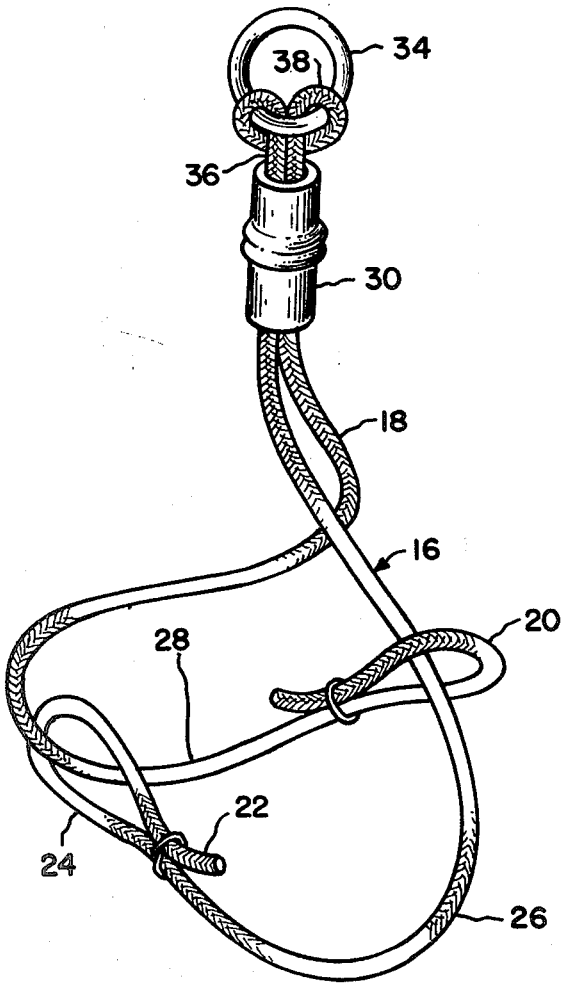
Fig. 1
Fig. 2
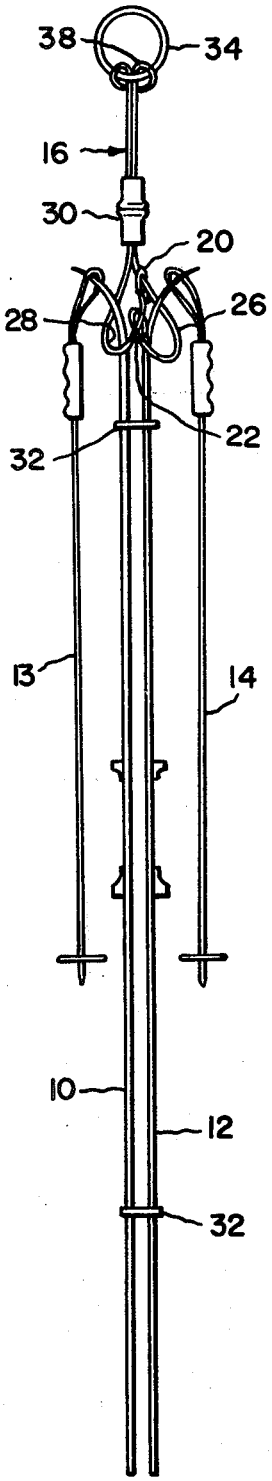

APPARATUS FOR SUSPENDING ARTICLES, SUCH AS SKIS, FOR CONVENIENT STORAGE

DESCRIPTION

The invention relates to suspensions for convenient storage of articles, such as skis which have curved ends.

Storing of skis conveniently is difficult because there are two of them and they are of an odd shape. What has been provided is a permanent bracket which is mounted on the wall and from which dowels project. The skis are placed back-to-back between the dowels and are held up by the skis' curved ends. The fixture is permanently mounted on the wall. It takes wall space which may not be available. It is also not especially secure and the skis can slide out from between the dowels.

It is an object of this invention to provide an improved suspension which may be used for storage of skis or other articles having curved ends.

It is another object of this invention to provide an improved suspension for hanging skis for storage which does not requre any special bracket or mounting but may be used on any hook or hanger, such that it may be carried along and used for temporary storage when the articles (e.g., skis) are not being used for skiing.

It is an object of this invention to provide an improved suspenion for storage of skis and the like which may be manufactured at very low cost.

The foregoing objects of the invention will be more fully apparent from a reading of the following description in connection with the accompanying drawings in which:

FIG. 1 is a perspective view of a ski hanger embodying the invention, and

FIG. 2 is a front view showing the hanger in use.

Referring to the drawings, there is shown a pair of skis 10 and 12 which are a representation of articles with curved ends which may be suspended and stored by means of the invention. Also shown are a pair of ski poles 13 and 14 which also may be stored with the skis 10 and 12. The suspension or hanger 16 is made of a single strand 18 of material. The material may be rawhide, which may be used for lighter articles such as cross country skis, or a nylon braided rope which is preferred for heavier articles such as downhill skis, water skis and the like.

One end of the strand 18 is overlapped and formed into loop 20. The loop is permanently fastened at where it is overlapped (viz., near the very end of the strand 18) by a piece of metal, such as a wire wrapped around the overlapped region or a crimped ring. The opposite end 22 of the strand 18 is then passed through the loop 20. Another loop 24 is formed at the opposite end around the strand above the first mentioned loop 20. In other words each end of the strand passes through the loop 20 and 24 at the end opposite thereto. The portions of the strands which extend away from the loops 20 and 24 form the article holding loops 26 and 28.

These holding loops are adjustable in size so as to fit the curved ends of the articles. Adjustment is provided for by means of a slide 30 (a tube for example as shown). The curved ends of the skis extend through the holding loops 26 and 28 and are adjusted in size so as to lock the skis in place. The skis are then held back-to-back, stored in a minimum space. The poles may even be held by their straps at the curved ends of the skis. It is preferable that ties 32 be placed around the skis near the rear ends thereof to avoid the possibility that they may spread apart at their rear ends.

The suspension 16 may be hung on any hook or even a nail or clothes hanger around the hook at the top of the clothes hanger. A ring 34 is used for convenience in hanging. The strands are folded over in the portion 36 through which the slide 30 extends and the folded-over portion extends through the slide. The terminus of the folded-over portion 36 is attached to the hook as by a slip knot 38.

From the foregoing description it will be apparent that an improved low cost suspension which is convenient to use for storing skis and similar articles have been described. Variations and modifications of the hereindescribed suspension may become apparent to those skilled in the art. Accordingly, the foregoing description should be taken as illustrative and not in a limiting sense.

What is claimed is:

1. Apparatus for suspending articles, such as pairs of skis, which have curved ends, so that they can be stored adjacent to each other, said apparatus comprising a single strand of flexible material, the ends of said strand being formed into permanent first loops, each end passing through the loop at the end opposite thereto with the strand forming a pair of second holding loops for said articles adjustable in size which extend along the length of the strand away from and between the first loops, a portion of the strand which extends away from the second loops being folded over, and a slide through which said folded over portion extends for adjusting the sizes of said second loops so that they fit around the curved ends of said articles and hold said articles when said folded portion is elevated above them.

2. The invention as set forth in claim 1 further comprising a ring adapted to be mounted on a hanger, the terminus of said folded portion of said strand being attached to said ring.

3. The invention as set forth in claim 2 wherein a slip knot is formed at said terminus to attach said strand to said ring.

4. The invention as set forth in claim 1 wherein said slide has a hole therethrough through which said folded portion passes.

5. The invention as set forth in claim 3 wherein said slide is a tubular member.

6. The invention as set forth in claim 1 wherein said ends of said strand are overlapped to form said first loops.

7. The invention as set forth in claim 6 wherein bodies of metal are disposed around said overlapped region of said strand ends to provide said permanent first loops.

8. The invention as set forth in claim 7 wherein said bodies are crimped to provide attachments which provide said permanent first loops.

9. The invention as set forth in claim 1 wherein said strand is of rawhide.

10. The invention as set forth in claim 1 wherein said strand is a braided rope.

11. The invention as set forth in claim 10 wherein said rope is of nylon.

* * * * *